US006980076B1

(12) United States Patent
Rolling et al.

(10) Patent No.: US 6,980,076 B1
(45) Date of Patent: Dec. 27, 2005

(54) ELECTRICAL APPARATUS WITH SYNTHETIC FIBER AND BINDER REINFORCED CELLULOSE INSULATION PAPER

(75) Inventors: David J. Rolling, Waukesha, WI (US); Richard L. Stegehuis, Helenville, WI (US); Richard M. Marusinec, Delafield, WI (US); Sam J. Ferrito, Oak Creek, WI (US)

(73) Assignee: McGraw Edison Company, Houston, TX (US)

( * ) Notice: Subject to any disclaimer, the term of this patent is extended or adjusted under 35 U.S.C. 154(b) by 372 days.

(21) Appl. No.: 09/573,158

(22) Filed: May 19, 2000

(51) Int. Cl.[7] ..... H01F 27/30
(52) U.S. Cl. ..... 336/207; 174/124 R
(58) Field of Search ..... 336/199, 205–208, 336/180; 174/110 R, 110 N, 110 PM, 110 D, 122 R, 120 C, 120 FP, 124 R

(56) References Cited

U.S. PATENT DOCUMENTS

| | | | | |
|---|---|---|---|---|
| 3,385,752 A | | 5/1968 | Selke et al. | |
| 3,917,901 A | | 11/1975 | Jones | |
| 3,934,332 A | * | 1/1976 | Trunzo | 336/206 |
| 3,980,803 A | | 9/1976 | Yasufuku et al. | |
| 4,081,776 A | | 3/1978 | Hisamoto et al. | |
| 4,095,205 A | * | 6/1978 | Schroeder et al. | 336/92 |
| 4,163,912 A | | 8/1979 | Gottung et al. | |
| 4,226,903 A | | 10/1980 | Gottung et al. | |
| 4,352,078 A | | 9/1982 | Moore | |
| 4,486,506 A | | 12/1984 | Kenjo et al. | |
| 4,536,734 A | | 8/1985 | Mabuchi | |
| 4,944,975 A | | 7/1990 | Sheer | |
| 5,223,095 A | * | 6/1993 | Kinsley, Jr. | 162/146 |
| 5,328,567 A | | 7/1994 | Kinsley, Jr. | |
| 5,368,929 A | | 11/1994 | Parker et al. | |
| 5,466,336 A | | 11/1995 | Kinsley, Jr. | |
| 5,498,314 A | | 3/1996 | Kinsley, Jr. | |
| 5,717,373 A | | 2/1998 | Vachris | |
| 5,766,725 A | | 6/1998 | Hogenboom et al. | |
| 5,800,675 A | * | 9/1998 | Kinsley, Jr. | 162/135 |
| 5,998,026 A | | 12/1999 | Ramachandran | |

FOREIGN PATENT DOCUMENTS

| | | |
|---|---|---|
| GB | 1 368 647 | 10/1974 |
| JP | 04 262317 | 9/1992 |

OTHER PUBLICATIONS

J. G. Ford, et al. "Insuldur–Another Milestone in Transformer Insulation Development" (INSULDUR), Oct., 1958, AIEE Transactions, vol. 77, Part III (pp. 804–808).
Beavers, et al. "Permalex, a New Insulation System" (Permalex, New Insulation System), Apr., 1960, AIEE Transactions, (pp. 64–73).
W. J. McNutt, et al. "Thermal Life Evaluation of High Temperature Insulation Systems and Hybrid Insulation Systems In Mineral Oil" (96 WM 221–2 PWRD), Jan. 21–25, 1996, IEE Power Engineering Society, (pp. 1–9).

* cited by examiner

*Primary Examiner*—Tuyen T. Nguyen
(74) *Attorney, Agent, or Firm*—Fish & Richardson P.C.

(57) ABSTRACT

An electrical apparatus includes at least one conductor and an insulation paper surrounding at least part of the conductor. The insulation paper includes a wood pulp fiber, a synthetic fiber, and a binder material. The synthetic fiber is present at between approximately 2 and 25 weight percent.

38 Claims, 4 Drawing Sheets

ELECTRICAL APPARATUS WITH SYNTHETIC FIBER AND BINDER REINFORCED CELLULOSE INSULATION PAPER

TECHNICAL FIELD

The application is related to electrical devices, such as transformers, that use paper insulation.

BACKGROUND

Electrical devices and components often employ paper insulation to surround and electrically insulate an electrical conductor. One such electrical device is a transformer that has at least two electric circuits that share a common magnetic flux, so that a voltage in one circuit magnetically induces a voltage in the other circuit. Another such electrical device is a reactor that has at least one electric circuit and a magnetic flux arranged to increase the impedance of an electric circuit. In either device, a magnetic path may be provided by an iron core. The electric circuits and the core may be immersed in a dielectric fluid in an enclosure. The conductors that make up the electric circuits are separated and electrically insulated from each other and from other components, such as the core and the enclosure, by paper insulation.

SUMMARY

In one general aspect, an electrical apparatus includes at least one conductor and an insulation paper surrounding at least part of the conductor. The insulation paper includes wood pulp fiber, synthetic fiber, and binder material. The synthetic fiber is present in the insulation paper in an amount between approximately 2 and 25 percent by weight.

Embodiments may include one or more of the following features. For example, the insulation paper may have a composition that includes between approximately 5 and 20 weight percent synthetic fiber, and more particularly between approximately 7 and 15 weight percent synthetic fiber. Ideally, the synthetic fiber has good long-term thermal aging properties and is compatible with common dielectric fluids. It may be, for example, aramid, syndiotactic polystyrene, polyphenylsulfone, polyphthalamide, or polyphenylene sulfide fiber, or combinations of those fibers. It may have a denier of between approximately 1 and 15, and more particularly between approximately 2 and 5. The fiber may have a length of between approximately 0.1 and 1.0 inches, and more particularly between approximately 0.25 and 0.75 inches.

The composition of the insulation paper may further include between approximately 5 and 35 weight percent binder, more particularly between approximately 10 and 30 weight percent, and most particularly between approximately 15 and 25 weight percent. Ideally, the binder material also has good long-term thermal aging properties and is compatible with common dielectric fluids. It may be, for example, polyvinyl alcohol, polyvinyl butyral, an acrylic resin, or a combination of these materials.

The composition of the insulation paper also may include between approximately 40 and 93 weight percent wood pulp fiber, more particularly between approximately 50 and 85 weight percent wood pulp fiber, and most particularly between approximately 60 and 78 weight percent wood pulp fiber. The insulation paper also may be formed as, for example, pressboard or crepe paper.

In one embodiment, the composition of the insulation paper may be approximately 10 weight percent aramid fiber, approximately 20 weight percent polyvinyl alcohol and approximately 70 weight percent wood pulp fiber. The insulation paper may further include a thermal stabilizing chemical applied to a surface of the paper. The stabilizer may be dicyandiamide.

The conductor of the electrical apparatus may include a winding of a transformer or a reactor, with the winding being insulated by insulation paper positioned around the winding. The winding and insulation paper may be installed in an enclosure, with a dielectric fluid in the enclosure surrounding the winding and the insulation paper. The dielectric fluid may be a mineral oil, silicone oil, a natural or synthetic ester oil, or a hydrocarbon fluid.

In another general aspect, a transformer includes a core, a first winding, a second winding, and insulation paper. Each winding includes at least one conductor that is surrounded at least partly by insulation paper. Insulation paper is positioned between the core, the first winding, and the second winding. The insulation paper includes wood pulp fiber, aramid fiber, polyvinyl alcohol, and a layer of dicyandiamide.

In another general aspect, a reactor includes a core, at least one winding, and insulation paper. The winding includes at least one conductor that is surrounded at least partly by insulation paper. Insulation paper is positioned between the core and the winding. The insulation paper includes wood pulp fiber, aramid fiber, polyvinyl alcohol, and a layer of dicyandiamide.

In another general aspect, a method of constructing an electrical device includes providing at least one conductor, providing an insulation paper, and surrounding at least part of the conductor with the insulation paper. The insulation paper includes wood pulp fiber, aramid fiber, and a binder material. The synthetic fiber is present in the insulation paper in an amount between approximately 2 and 25 percent by weight.

In another general aspect, an insulated conductor includes an electrical conductor that is surrounded at least partly by an insulating paper. The insulating paper includes wood pulp fiber, a synthetic fiber, and a binder material. The synthetic fiber is present in the insulation paper in an amount between approximately 2 and 25 percent by weight. In some applications, the insulated conductor may be installed in a transformer or a reactor.

In another general aspect, a method of making an insulated conductor includes providing a conductor, providing an insulating paper, and covering the conductor with the insulating paper. The insulating paper includes wood pulp fiber, a synthetic fiber, and a binder material. The insulation paper may be wrapped around the conductor. The synthetic fiber is present in the insulation paper in an amount between approximately 2 and 25 percent by weight. The insulated conductor may be installed in a transformer or reactor.

In another general aspect, a compressed pulp product includes a wood pulp fiber, a synthetic fiber, and a binder material. The wood pulp fiber, the synthetic fiber, and the binder material together form a compressed pulp product having a thickness of at least 30 mils.

In another general aspect, a method of making a compressed pulp product includes providing wood pulp fiber, a synthetic fiber, and a binder material; mixing the wood pulp fiber, the synthetic fiber, and the binder material to form a mixture; processing the mixture; and compressing the mixture. The wood pulp fiber, the synthetic fiber, and the binder material together form a compressed pulp product having a thickness of at least 30 mils.

In another general aspect, an electrical apparatus includes at least one conductor and an insulation paper surrounding at least part of the conductor. The insulation paper comprises a wood pulp fiber, aramid fiber, and a binder material.

In another general aspect, an electrical apparatus includes at least one conductor; and an insulation paper surrounding at least part of the conductor. The insulation paper includes a wood pulp fiber, a binder material, and a synthetic fiber that includes one or more of an aramid fiber, a syndiotactic polystyrene fiber, a polyphenylsulfone fiber, a polyphthalamide fiber, and a polyphenylene sulfide.

Embodiments of these other aspects of the invention may include one or more of the features discussed above.

The insulation paper used in a fluid-immersed electrical device provides considerable advantages. For example, in comparison to thermally upgraded or non-thermally upgraded kraft paper, the insulation paper maintains its mechanical strength and integrity for a longer period of time when subjected to the same temperature history. This improves the longevity of the electrical device in which the insulation paper is used, which reduces maintenance costs in terms of labor and replacement parts.

As a consequence of its ability to maintain mechanical strength and integrity better than ordinary kraft paper, an electrical device using the insulation paper can be made smaller, which reduces the cost of the device. However, reducing the size of an electrical device while maintaining its operating characteristics (e.g., voltage and amperage) causes the device to operate at a higher temperature relative to a larger electrical device with the same operating characteristics because there is less heat-transferring fluid and exposed surface area to cool the device. Because the insulation paper maintains its strength and integrity, it may have an operating temperature that is increased by approximately 5° Celsius to 25° Celsius above thermally upgraded or non-thermally upgraded kraft paper. Consequently, a smaller device fabricated with the insulation paper that is operating at a temperature that is 5° Celsius to 25° Celsius higher than a conventional, larger device, can operate for a period similar to the larger device before the insulation paper fails.

Other features and advantages will be apparent from the following description, including the drawings, and from the claims.

DESCRIPTION

Figure 1:
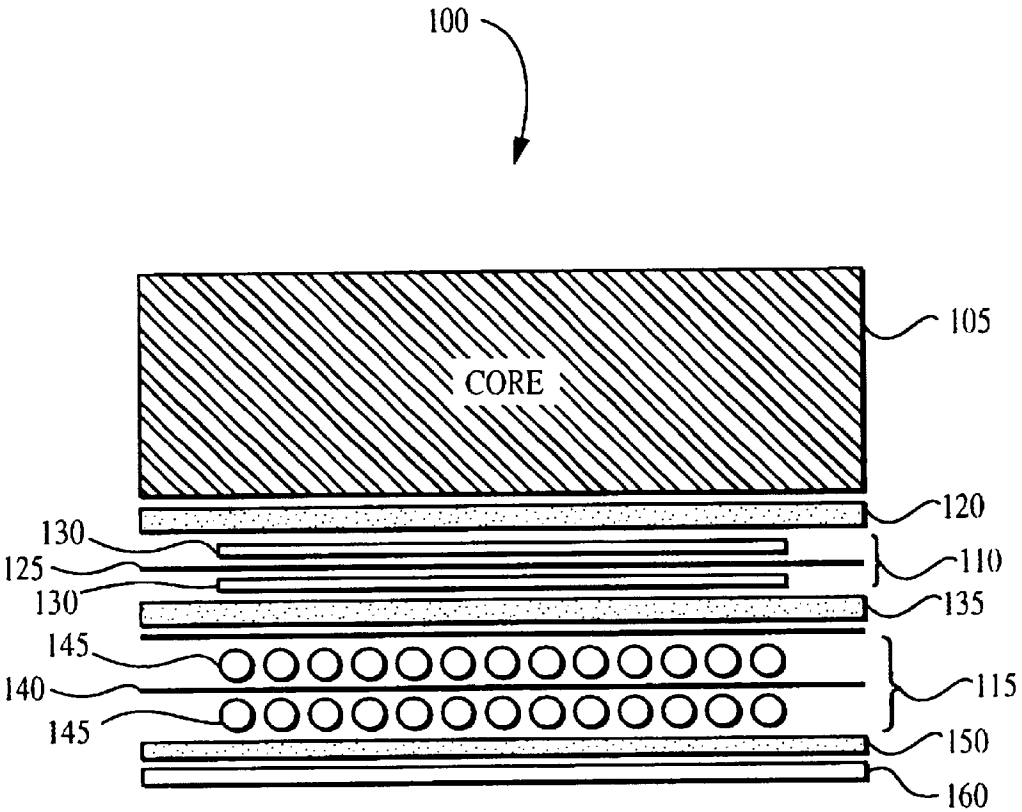
FIG. 1 is a sectional side view of an insulation structure of a transformer.

Referring to FIG. 1, an insulation structure of a transformer 100 includes a core 105, a second winding layer 110, and a first winding layer 115. A form insulation layer 120 electrically separates the core 105 from the second winding layer 110. A second insulation layer 125 separates the individual coils 130 of the second winding layer 110. A barrier insulation layer 135 separates the second winding layer 110 and the first winding layer 115. A first insulation layer 140 separates the individual coils 145 of the first layer 115. A coil wrap 150 surrounds the first layer 115 and electrically separates it from the enclosure (not shown) in which the core 105 and winding layers 110 and 115 are inserted. An optional coil-to-coil insulation layer 160 is positioned adjacent to the coil wrap 150. The layer 160 typically is made of a pressboard product and is inserted adjacent to the coil wrap 150. A dielectric fluid fills the enclosure and surrounds the core, winding layers, and insulation layers. This is a common transformer coil construction. Other coil constructions are also commonly used in the industry, depending on the type of transformer and its application. The transformer windings may be connected to make an autotransformer, and the autotransformer may be used in, for example, a voltage regulator.

The dielectric fluid in the transformer may be any suitable dielectric fluid, such as mineral oil, R-temp, Envirotemp FR-3, Envirotemp 200, Edisol TR, and silicone oil. Mineral oil and silicone oil are commonly available from a variety of distributors. R-temp is the brand name of a high molecular weight hydrocarbon fluid. Envirotemp FR-3 is the brand name of a natural ester fluid. Envirotemp 200 is the brand name of a synthetic ester fluid. Edisol TR is the brand name of a synthetic hydrocarbon fluid. R-temp, Envirotemp FR-3, Envirotemp 200, and Edisol TR are all available from Cooper Power Systems of Waukesha, Wis.

The insulating layers in the transformer are a synthetic fiber and binder reinforced cellulose insulation paper. The individual conductors in the transformer may also be wrapped with the same insulation paper. In general, the paper is made of wood pulp fiber, a synthetic fiber, and a binder. The paper also may include a thermal stabilizing chemical.

The insulation may be made using a range of content of wood pulp fiber, synthetic fibers and binder. The synthetic fibers may be aramid, syndiotactic polystyrene, polyphenylsulfone, polyphthalamide, or polyphenylene sulfide fibers that are present in an amount between approximately 2 and 25 weight percent of the mixture, more particularly between approximately 5 and 20 weight percent, and most particularly between approximately 7 and 15 weight percent. The fibers may have a denier from approximately 1 to 15, more particularly from approximately 2 to 5, and a fiber length of approximately 0.1 to 1.0 inches, more particularly between approximately 0.25 to 0.75 inches. The binder may be polyvinyl alcohol, polyvinyl butyral, or an acrylic resin that is present in an amount between approximately 5 and 35 weight percent of the mixture, more particularly between approximately 10 and 30 weight percent, and most particularly between 15 and 25 weight percent. The wood pulp fiber is present in an amount between approximately 40 and 93 weight percent of the mixture, more particularly between 50 and 85 weight percent, and most particularly between 60 and 78 weight percent.

One exemplary formulation of the components is made of approximately 70 weight percent wood pulp fiber, approximately 10 weight percent aramid fibers, and approximately 20 weight percent polyvinyl alcohol. In this formulation, the aramid fibers have a denier of 2 and a length of approximately 0.25 inches. A thermal stabilizing chemical, such as dicyandiamide, may be applied during the production of the paper produced from this formulation. The insulation paper made from this combination of materials has physical characteristics that are very similar to thermally upgraded kraft paper. The insulation paper is slightly stiffer than kraft paper, which is useful during assembly of the windings.

Adding the synthetic fiber to the wood pulp fiber improves the thermal properties of thermally upgraded or non-thermally upgraded kraft paper, both of which are made from cellulose. Aramid fibers are available from E.I. DuPont du Nemours and Company of Wilmington, Del., under the trade name NOMEX and from Teijin Limited of Osaka, Japan under the trade name TEIJINCONEX. Syndiotactic polystyrene is available from Dow Chemical Company of Midland, Mich. under the trade name Questra. Polyphenylsulfone is available from Amoco Performance Products, Inc of Marietta, Ohio under the trade name Radel-R. Polyphthalamide is available from E.I. DuPont du Nemours and Company of Wilmington, Del. under the trade name Zytel HTN. Polyphenylene sulfide is available from Phillips Chemical Company of Bartlesville, Okla. under the trade name Ryton.

The binder is added to improve the bonding of the wood pulp fiber and the synthetic fibers, since the synthetic fibers interfere with the wood pulp's bonding ability. The binder corrects for that interference so that the wood pulp and synthetic fibers will bond. Polyvinyl alcohol, polyvinyl butyral, and acrylic resins, which function as binders, are commonly available from a variety of chemical suppliers.

The thermal stabilizing chemical is applied to the paper after it is has been formed into a sheet. The stabilizer represses the decomposition of the cellulose molecules in the wood pulp fiber and also represses the decomposition of certain types of binder molecules, such as polyvinyl alcohol. Dicyandiamide, which is used as a stabilizer, is commonly available from a variety of chemical suppliers.

When used in transformer 100, or other fluid-filled electrical devices, the paper thermally ages, which causes the wood pulp fiber component of the paper to become brittle and lose mechanical strength. Even though the wood pulp fiber becomes brittle, it continues to have good dielectric properties so long as the paper remains intact and impregnated with fluid. The synthetic fiber component, on the other hand, retains its mechanical strength even while the wood pulp fiber component loses its strength. The synthetic fibers thus function as a reinforcing web or backbone to maintain some mechanical integrity and strength of the paper. In this manner, the synthetic backbone can keep the paper intact even when the electrical device is subjected to electrical and mechanical stresses that would otherwise cause the ordinary kraft paper to fail and cause the device to cease functioning.

The insulation paper may be made using conventional paper making techniques, such as on cylinder or fourdrinier paper making machines. In general, wood pulp fiber in water is chopped and refined to obtain the proper fiber size. The chopped, refined fiber then is crushed to increase the surface area of the fibers. The synthetic fibers and binder are added to the mixture of wood pulp fibers and water.

The mixture then is screened to drain the water from the mixture to form a sheet of paper. The screen tends to orient the fibers in the direction in which the sheet is moving, which is referred to as the machine direction. Consequently, the resulting insulation paper has a greater tensile strength in the machine direction than in the perpendicular direction, which is referred to as the cross direction. The sheet of paper is fed from the screen onto rollers and through other processing equipment that removes the water in the paper. During the processing, the stabilizer is added to the paper by, for example, wetting the surface of the paper with the chemical solution.

Tables 1–7 demonstrate the mechanical properties of two formulations (aramid reinforced paper #1 and aramid reinforced paper #2) of the paper that have been tested and compared to thermally upgraded kraft paper. The aramid reinforced papers #1 and #2 have the same composition described above (approximately 70 weight percent wood pulp fiber, approximately 10 weight percent aramid fiber, and approximately 20 weight percent polyvinyl alcohol) but were processed differently during the refinement step. Aramid reinforced paper #2 was refined for a longer period than aramid reinforced paper #1. The refining step involves crushing and chopping the fibers to increase the surface area of the fibers. The aramid reinforced papers and thermally upgraded kraft paper have a 10 mils thickness and are aged in mineral oil at 170° Celsius. Also present in the test containers were materials commonly found in electrical devices, such as copper, aluminum, magnet wire, core steel, and pressboard, to rule out any chemical incompatibilities.

On all of the tables, the standard deviation of the test values is shown under the average value, preceded by "±". Tables 1 and 2 list the tensile strength and elongation results, respectively, of tensile testing of the paper in the machine direction. Tables 3 and 4 list the tensile strength and elongation results, respectively, of the tensile testing of the papers in the cross direction. These tests were performed according to ASTM D828.

TABLE 1

Machine Direction Tensile Testing (Tensile Strength - ASTM D828)

| | Time | | | | |
|---|---|---|---|---|---|
| Paper | Unaged (Pounds per square inch) | 500 hours (Pounds per square inch) | 1000 hours (Pounds per square inch) | 2000 hours (Pounds per square inch) | 4000 hours (Pounds per square inch) |
| Thermally Upgraded Kraft Paper | 13,840 ± 2,533 | 9,333 ± 1,495 | 6,588 ± 906 | 590* ± 133 | 2,311 ± 410 |
| Aramid Reinforced Paper #1 | 20,598 ± 966 | 13,052 ± 1,460 | 7,059 ± 825 | 5,467 ± 712 | 3,720 ± 562 |
| Aramid Reinforced Paper #2 | 22,115 ± 545 | 12,691 ± 1,613 | 6,363 ± 798 | 5,457 ± 742 | 3,671 ± 1,310 |

*This test container did not seal and may have become contaminated.

TABLE 2

| Machine Direction Tensile Testing (Elongation - ASTM D828) | | | | | |
|---|---|---|---|---|---|
| Time<br>Paper | Unaged<br>(Percent) | 500 hours<br>(Percent) | 1000 hours<br>(Percent) | 2000 hours<br>(Percent) | 4000 hours<br>(Percent) |
| Thermally Upgraded Kraft Paper | 1.7 ± 0.51 | 0.58 ± 0.13 | 0.38 ± 0.06 | 0.35 ± 0.07 | 0.39 ± 0.05 |
| Aramid Reinforced Paper #1 | 2.3 ± 0.17 | 0.74 ± 0.11 | 0.36 ± 0.06 | 0.29 ± 0.04 | 0.44 ± 0.04 |
| Aramid Reinforced Paper #2 | 2.3 ± 0.06 | 0.69 ± 0.11 | 0.31 ± 0.05 | 0.28 ± 0.04 | 0.47 ± 0.08 |

TABLE 3

| Cross Direction Tensile Testing (Tensile Strength - ASTM D828) | | | | | |
|---|---|---|---|---|---|
| | Time | | | | |
| Paper | Unaged<br>(Pounds per square inch) | 500 hours<br>(Pounds per square inch) | 1000 hours<br>(Pounds per square inch) | 2000 hours<br>(Pounds per square inch) | 4000 hours<br>(Pounds per square inch) |
| Thermally Upgraded Kraft Paper | 4,779 ± 282 | 3,441 ± 155 | 2,393 ± 131 | 1,698 ± 565 | 953 ± 109 |
| Aramid Reinforced Paper #1 | 4,623 ± 111 | 3,347 ± 57 | 2,058 ± 341 | 1,829 ± 195 | 1,326 ± 145 |
| Aramid Reinforced Paper #2 | 4,890 ± 128 | 3,710 ± 183 | 2,185 ± 153 | 1,604 ± 272 | 1,784 ± 102 |

TABLE 4

| Cross Direction Tensile Testing (Elongation - ASTM D828) | | | | | |
|---|---|---|---|---|---|
| Time<br>Paper | Unaged<br>(Percent) | 500 hours<br>(Percent) | 1000 hours<br>(Percent) | 2000 hours<br>(Percent) | 4000 hours<br>(Percent) |
| Thermally Upgraded Kraft Paper | 4.7 ± 0.55 | 1.1 ± 0.16 | 0.60 ± 0.09 | 0.43 ± 0.08 | 0.55 ± 0.08 |
| Aramid Reinforced Paper #1 | 5.9 ± 0.60 | 1.1 ± 0.07 | 0.44 ± 0.10 | 0.70 ± 0.12 | 0.69 ± 0.06 |
| Aramid Reinforced Paper #2 | 5.5 ± 0.08 | 1.1 ± 0.18 | 0.41 ± 0.06 | 0.70 ± 0.07 | 0.75 ± 0.04 |

Table 5 lists the bursting strength testing results of the insulation papers. During the burst testing procedure, the paper is clamped between a pair of plates that have adjacent openings. A diaphragm is inflated against the paper through one of the openings, and the pressure at which the diaphragm bursts through the paper is recorded. This is also commonly called the Mullen test, and it is performed according to ASTM D774.

TABLE 5

| Bursting Strength Testing (ASTM D774) | | | | | |
|---|---|---|---|---|---|
| | Time | | | | |
| Paper | Unaged<br>(Pounds per square inch) | 500 hours<br>(Pounds per square inch) | 1000 hours<br>(Pounds per square inch) | 2000 hours<br>(Pounds per square inch) | 4000 hours<br>(Pounds per square inch) |
| Thermally Upgraded Kraft Paper | 200 | 44 ± 7 | 14 ± 1 | 3 ± 0.4 | 2.5 ± 0.3 |
| Aramid Reinforced Paper #1 | 170 ± 14 | 31 ± 2 | 18 ± 1 | 14 ± 1.0 | 8 ± 1.1 |
| Aramid Reinforced Paper #2 | 160 ± 6 | 33 ± 2 | 19 ± 1 | 14 ± 1.5 | 16 ± 1.0 |

Table 6 lists the test results of the fold endurance test for the papers. The paper is repeatedly folded and unfolded until it is severed at the crease, and that number of double folds is recorded. This test is performed according to ASTM D2176.

TABLE 6

Fold Endurance Testing (ASTM D2176)

| Paper | Time: Unaged (Number of times folded) | 500 hours (Number of times folded) | 1000 hours (Number of times folded) | 2000 hours (Number of times folded) | 4000 hours (Number of times folded) |
|---|---|---|---|---|---|
| Thermally Upgraded Kraft Paper | 1,200 ± 290 | 1 ± 1.0 | 0 | 0 | 0 |
| Aramid Reinforced Paper #1 | 219 ± 74 | 7 ± 2.4 | 3 ± 0.9 | 2 ± 1.4 | 0 |
| Aramid Reinforced Paper #2 | 329 ± 89 | 20 ± 14.5 | 7 ± 2.9 | 3 ± 1.5 | 6 ± 3 |

Table 7 lists the results of the measurement of the dielectric breakdown strength of the paper after impregnation with mineral oil. The paper is placed between two electrodes in a mineral oil bath, and one of the electrodes is energized with a 60 Hz AC source while the other remains at ground potential. The voltage is increased at a constant rate until breakdown occurs. This test is performed according to ASTM D149.

TABLE 7

Paper Dielectric Breakdown Strength Testing (ASTM D149)

| Time<br>Paper | 500 hours (kilovolts) | 1000 hours (kilovolts) | 2000 hours (kilovolts) | 4000 hours (kilovolts) |
|---|---|---|---|---|
| Thermally Upgraded Kraft Paper | 14.08 ± 0.39 | 14.40 ± 0.52 | 13.31 ± 0.73 | 14.03 ± 0.64 |
| Aramid Reinforced Paper #1 | 13.98 ± 0.42 | 13.84 ± 0.43 | 13.40 ± 0.67 | 13.70 ± 0.62 |
| Aramid Reinforced Paper #2 | 12.92 ± 1.17 | 14.04 ± 0.60 | 13.91 ± 0.28 | 13.91 ± 0.40 |

Tables 8–13 list the results of various tests of the dielectric oil in which the paper is aged that tests the effects of the paper and aging on the dielectric oil. These test results indicate the suitability of the paper for use as insulation paper in a dielectric fluid. Table 8 lists the moisture content of the oil in parts per million as tested per ASTM D1533B.

TABLE 8

Moisture Content Testing (ASTM D1533B)

| Time<br>Paper | 500 hours (Parts per million) | 1000 hours (Parts per million) | 2000 hours (Parts per million) | 4000 hours (Parts per million) |
|---|---|---|---|---|
| Thermally Upgraded Kraft Paper | 11 | 18 | 66 | 35 |
| Aramid Reinforced Paper #1 | 13 | 8 | 26 | 12 |
| Aramid Reinforced Paper #2 | 5 | 9 | 18 | 12 |

Table 9 lists the acid number (in milligrams of KOH/gram) tested per ASTM D664. As oil degrades at higher temperatures, it creates acid. The test measured the acid content of the oil as it was aged.

TABLE 9

Acid Content Testing (ASTM D664)

| Time<br>Paper | 500 hours<br>(mg KOH/g) | 1000 hours<br>(mg KOH/g) | 2000 hours<br>(mg KOH/g) | 4000 hours<br>(mg KOH/g) |
|---|---|---|---|---|
| Thermally Upgraded Kraft Paper | 0.011 | 0.022 | 0.117 | 0.173 |
| Aramid Reinforced Paper #1 | 0.014 | 0.025 | 0.065 | 0.111 |
| Aramid Reinforced Paper #2 | 0.010 | 0.027 | 0.060 | 0.173 |

Table 10 lists the interfacial tension (IFT) in dynes per cm that is measured for the aged paper as tested per ASTM D971. The IFT testing provides a measure of the level of polar impurities in the oil created as it, and the materials surrounded by the oil, age.

TABLE 10

Interfacial Tension Testing (ASTM D971)

| Time<br>Paper | 500 hours<br>(Dynes/cm) | 1000 hours<br>(Dynes/cm) | 2000 hours<br>(Dynes/cm) | 4000 hours<br>(Dynes/cm) |
|---|---|---|---|---|
| Thermally Upgraded Kraft Paper | 34.0 | 32.2 | 30.1 | 29.2 |
| Aramid Reinforced Paper #1 | 32.2 | 29.7 | 29.1 | 28.6 |
| Aramid Reinforced Paper #2 | 32.8 | 31.7 | 30.1 | 22.6 |

Table 11 lists the results of measuring the dielectric strength of the oil, per ASTM D877, as it is aged with the materials immersed in it. As the oil and materials age, the oil's dielectric properties may break down.

TABLE 11

Oil Dielectric Breakdown Strength Testing (ASTM D877)

| Time<br>Paper | 500 hours<br>(kV) | 1000 hours<br>(kV) | 2000 hours<br>(kV) | 4000 hours<br>(kV) |
|---|---|---|---|---|
| Thermally Upgraded Kraft Paper | 52 | 42 | 47 | 43 |
| Aramid Reinforced Paper #1 | 51 | 46 | 60 | 46 |
| Aramid Reinforced Paper #2 | 44 | 43 | 44 | 40 |

Table 12 lists the results of dissipation factor testing, per ASTM D924. Dissipation factor measures the power lost when a dielectric material is subjected to an AC field. As the oil ages, it may have increased electrical energy losses because of an increased concentration of impurities.

TABLE 12

Dissipation Factor Testing (ASTM D924)

| Time<br>Paper | 500 hours<br>(%) | 1000 hours<br>(%) | 2000 hours<br>(%) | 4000 hours<br>(%) |
|---|---|---|---|---|
| Thermally Upgraded Kraft Paper | <0.0001 | <0.0001 | 0.0001 | 0.0043 |
| Aramid Reinforced Paper #1 | <0.0001 | <0.0001 | <0.0001 | <0.0001 |
| Aramid Reinforced Paper #2 | <0.0001 | <0.0001 | <0.0001 | 0.0141 |

Table 13 lists the volume resistivity, as tested per ASTM D1169. The resistivity of the oil may decrease as the oil ages because of an increase in impurities in the oil.

TABLE 13

| Volume Resistivity Testing (ASTM D1169) | | | | |
|---|---|---|---|---|
| Time<br>Paper | 500 hours<br>(Ohm-cm) | 1000 hours<br>(Ohm-cm) | 2000 hours<br>(Ohm-cm) | 4000 hours<br>(Ohm-cm) |
| Thermally Upgraded Kraft Paper | $280 \times 10^{12}$ | $307 \times 10^{12}$ | $390 \times 10^{12}$ | $75 \times 10^{12}$ |
| Aramid Reinforced Paper #1 | $317 \times 10^{12}$ | $323 \times 10^{12}$ | $411 \times 10^{12}$ | $500 \times 10^{12}$ |
| Aramid Reinforced Paper #2 | $299 \times 10^{12}$ | $319 \times 10^{12}$ | $383 \times 10^{12}$ | $11 \times 10^{12}$ |

Tables 1–13 demonstrate that the insulation papers made with aramid fibers and polyvinyl alcohol provide an improved insulation paper for electrical devices in which an insulation paper is immersed in a dielectric fluid. The tables also demonstrate that the paper does not adversely affect the dielectric fluid, and has an effect on the oil that is similar to thermally upgraded kraft paper.

Other types of insulating paper can be made using the compositions described above. For example, an insulating paper using the compositions can be formed as crepe paper. In general, crepe paper is formed in the same manner as the insulation paper described above. The paper is slightly moistened and passed from a payout roll to a pickup roll. The pickup roll turns at a slightly slower speed that the payout roll such that the paper backs up in the area between the rolls and is slightly crimped. The crepe paper formed in this manner can be used as insulation, for example, to insulate coil leads or internal transformer wires. The crepe paper can be used over bare conductors and over conductors that are already overcoated with an insulation material. The crepe paper also can be used to supplement regular paper in some coil designs, such as in the function of a high-low barrier insulation. Due to the flexibility of crepe paper, it can be wrapped around the various conductors, coil leads, and wires that are used in a transformer or reactor.

Pressboard, a compressed pulp product, is another example of an insulating paper that can be formed using the compositions described above. Pressboard products used in, for example, transformers and reactors, typically have a thickness of between 30 mils and 250 mils. Pressboard is used to provide a dielectric and a mechanical support function. For example, pressboard can be used as the coil-to-coil insulation described above with respect to FIG. 1. Because pressboard is rigid, it typically is not wrapped around a conductor, as is the case with the more flexible crepe paper and insulation paper described above. Nonetheless, pressboard can be shaped to conform to some of the various configurations of a transformer or reactor. For example, it can be shaped to fit inside a coil window of a transformer or to be placed between the core and coils of a transformer.

Techniques for making pressboard are well known in the paper making industry. In general, when making pressboard using the compositions described above, the binder, wood pulp fiber, and synthetic fibers are refined beyond the refining used in making the insulation paper described above. The additional refining increases the bonding forces between the fibers. Typically, the mixture of binder and fibers is mixed with water and conveyed to a wide, rotary cylindrical screen. The water flows through the screen and the fibers are filtered out onto the screen surface to form a paper web layer. A felt layer removes the paper web layer from the screen and conveys the layer to a forming roll. The layer then is wet laminated to form the required thickness by the continuous winding of the paper layer onto the forming roll. Once it is wound on the forming roll, the material is pressed in a pressing operation until the material contains approximately 55% water. The material then is dried under heat with the pressure removed until the material contains approximately 5% water. The material then is further compressed using heavy calenders to give a thickness of the product that is in the range, for example, of between approximately 30 mils to 250 mils, depending upon the desired application.

Other embodiments are within the scope of the following claims. For example, the insulation papers can be used in reactors. A reactor is an induction device that has at least one winding and a magnetic flux. The winding is suitably adapted and arranged to increase the impedance of an electrical circuit.

Figure 2:
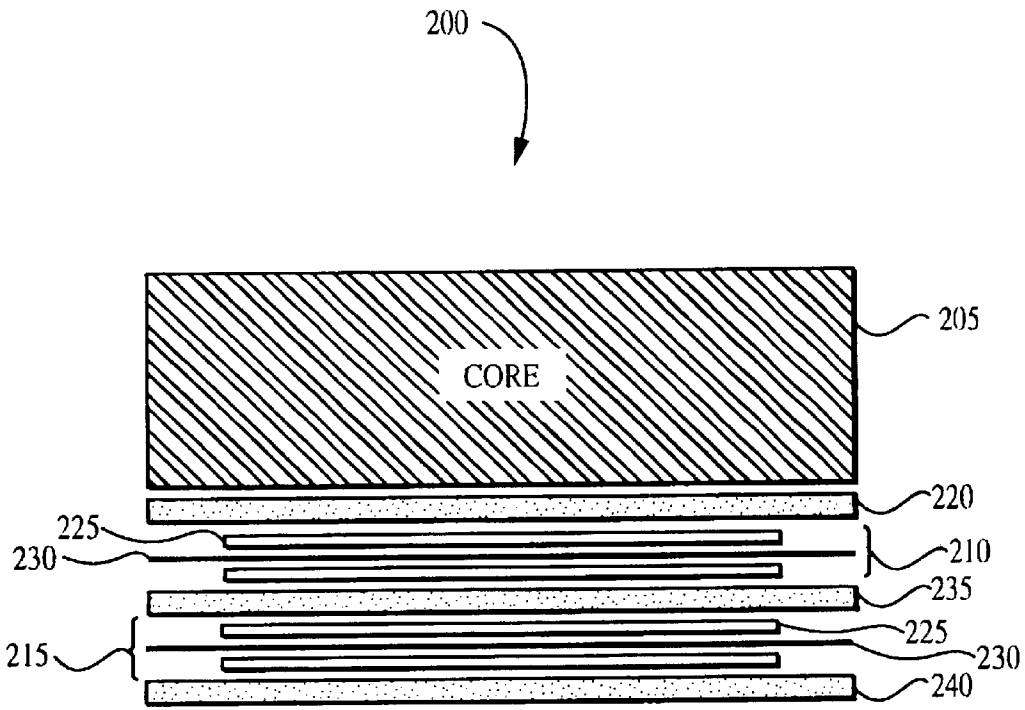
FIG. 2 is a sectional side view of an insulation structure of a reactor.

Referring to FIG. 2, a reactor 200 includes a core 205, a first winding section 210 and a second winding section 215. A layer of form insulation 220 electrically separates the first winding section 210 from the core 205. The first winding section 210 and the second winding section 215 include individual windings 225 that are electrically separated by a layer of insulation 230. The first winding section 210 and the second winding section 215 are electrically separated by section insulation 235. A coil wrap 240 surrounds the second winding section 215. The core, windings, and layers of insulation are enclosed by a container and immersed in a dielectric fluid, such as those described above. The various layers of insulation may be made from a paper, crepe paper, or pressboard having the compositions described above.

Although the reactor 200 illustrated in FIG. 2 has two winding sections (210, 215), a reactor may have only one winding section. In such a design, the section insulation 235 and the second winding section 215 are not used and the coil wrap 240 surrounds the first winding section 210.

Figure 3:
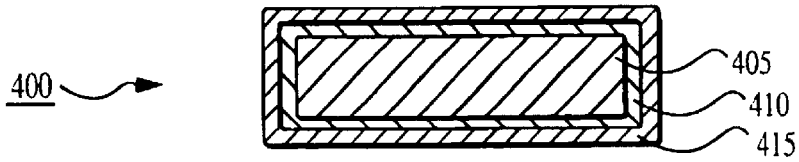
FIG. 3 is a sectional front view of a rectangular wire conductor.
Figure 4:
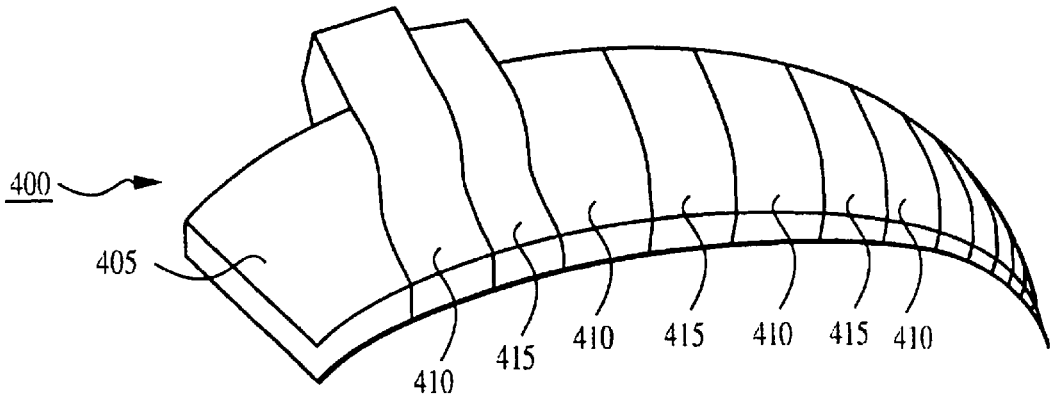
FIG. 4 is a perspective view of the conductor of FIG. 3.

The insulation paper also can be used in numerous applications in which insulation paper is commonly used, such as the insulation paper used in paper-covered conductors. One type of paper-covered conductor is the rectangular wire used in larger transformers. These wires are wrapped with insulation paper. For example, referring to FIGS. 3 and 4, a conductor 400 includes a rectangular wire 405 that is loosely wrapped with a pair of continuous strips of insulation paper 410 and 415 such that they overlap. The insulation paper 410 and 415 may be the insulation paper described above or crepe paper. It also may be shaped pressboard.

Figure 5:
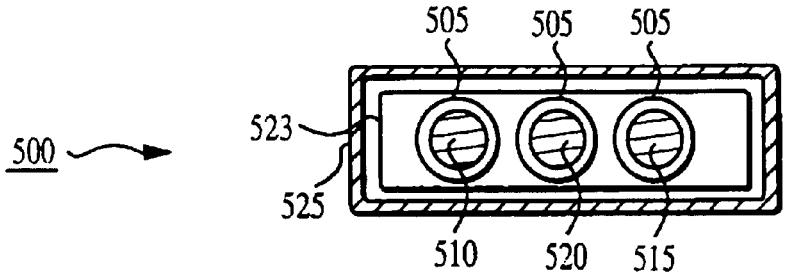
FIG. 5 is a sectional front view of a three-wire conductor.
Figure 6:
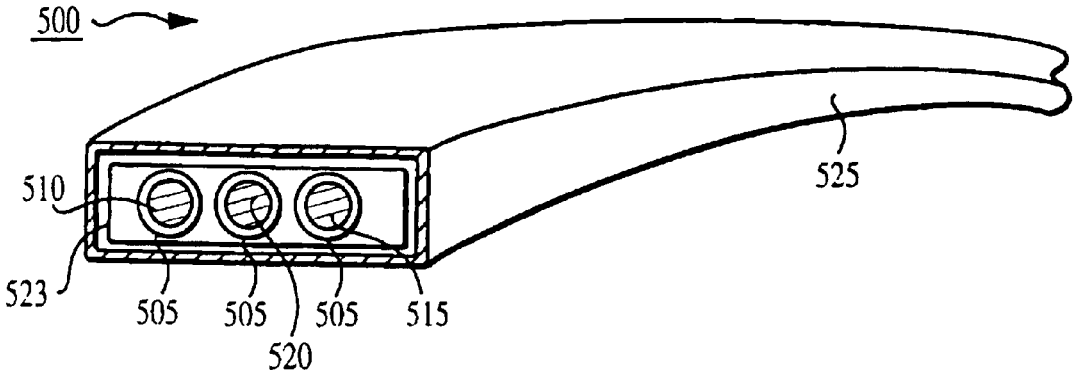
FIG. 6 is a perspective view of the conductor of FIG. 5.

Referring to FIGS. 5 and 6, another type of paper-covered conductor is common heavy gauge house wiring 500, which has layers of plastic or rubber insulation 505 surrounding the common 510 and live 515 wires. The ground wire 520, which is positioned between the common wire 510 and the live wire 515, optionally is covered by insulation material, as illustrated in FIGS. 5 and 6. The insulation and wires are over-coated with a layer of insulation paper 523, which is over-coated by a plastic or rubber insulation layer 525.

What is claimed is:

1. An electrical apparatus comprising:

at least one conductor; and an insulation paper surrounding at least part of the conductor, wherein the insulation paper comprises a wood pulp fiber, between approximately 2 and 25 weight percent of a synthetic fiber, and a binder material.

2. The electrical apparatus of claim 1, wherein the synthetic fiber comprises one or more of an aramid fiber, a syndiotactic polystyrene fiber, a polyphenylsulfone fiber, a polyphthalamide fiber, or a polyphenylene sulfide fiber.

3. The electrical apparatus of claim 1, wherein the synthetic fiber has a denier of between approximately 1 and 15.

4. The electrical apparatus of claim 3, wherein the synthetic fiber has a denier of between approximately 2 and 5.

5. The electrical apparatus of claim 1, wherein the synthetic fiber has a length of between approximately 0.1 and 1.0 inches.

6. The electrical apparatus of claim 5, wherein the synthetic fiber has a length of between approximately 0.25 and 0.75 inches.

7. The electrical apparatus of claim 1, wherein the binder material comprises polyvinyl alcohol.

8. The electrical apparatus of claim 1, wherein the binder material comprises polyvinyl butyral.

9. The electrical apparatus of claim 1, wherein the binder material comprises acrylic resin.

10. The electrical apparatus of claim 1, wherein the composition of the insulation paper comprises between approximately 5 and 20 weight percent synthetic fiber.

11. The electrical apparatus of claim 10, wherein the composition of the insulation paper comprises between approximately 7 and 15 weight percent synthetic fiber.

12. The electrical apparatus of claim 1, wherein the composition of the insulation paper further comprises between approximately 5 and 35 weight percent binder.

13. The electrical apparatus of claim 1, wherein the composition of the insulation paper further comprises between approximately 10 and 30 weight percent binder.

14. The electrical apparatus of claim 1, wherein the composition of the insulation paper further comprises between approximately 15 and 25 weight percent binder.

15. The electrical apparatus of claim 1, wherein the composition of the insulation paper further comprises between approximately 40 and 93 weight percent wood pulp fiber.

16. The electrical apparatus of claim 1, wherein the composition of the insulation paper further comprises between approximately 50 and 85 weight percent wood pulp fiber.

17. The electrical apparatus of claim 1, wherein the composition of the insulation paper further comprises between approximately 60 and 78 weight percent wood pulp fiber.

18. The electrical apparatus of claim 1, wherein the composition of the insulation paper comprises:

approximately 10 weight percent aramid fiber;

approximately 20 weight percent polyvinyl alcohol; and approximately 70 weight percent wood pulp fiber.

19. The electrical apparatus of claim 1, wherein the insulation paper further comprises at least one layer of a thermal stabilizing chemical applied to a surface of the paper.

20. The electrical apparatus of claim 19, wherein the thermal stabilizing chemical comprises dicyandiamide.

21. The electrical apparatus of claim 1, wherein the conductor comprises a winding, the winding is insulated by insulation paper, the winding and the insulation paper are installed in an enclosure, and a dielectric fluid in the enclosure surrounds the winding and the insulation paper.

22. The electrical apparatus of claim 21, wherein the winding comprises a component of a transformer.

23. The electrical apparatus of claim 22, wherein the transformer comprises an autotransformer.

24. The electrical apparatus of claim 23, wherein the autotransformer comprises a component of a voltage regulator.

25. The electrical apparatus of claim 21, wherein the winding comprises a component of an autotransformer.

26. The electrical apparatus of claim 21, wherein the winding comprises a component of a reactor.

27. The electrical apparatus of claim 22, wherein the transformer comprises a component of a voltage regulator.

28. The electrical apparatus of claim 21, wherein the dielectric fluid comprises a mineral oil.

29. The electrical apparatus of claim 21, wherein the dielectric fluid comprises silicone oil.

30. The electrical apparatus of claim 21, wherein the dielectric fluid comprises an ester oil.

31. The electrical apparatus of claim 21, wherein the dielectric fluid comprises a hydrocarbon fluid.

32. The electrical apparatus of claim 1, wherein the insulation paper comprises pressboard.

33. The electrical apparatus of claim 1, wherein the insulation paper comprises crepe paper.

34. An electrical apparatus comprising:

at least one conductor; and an insulation paper surrounding at least part of the conductor, wherein the insulation paper comprises a wood pulp fiber, a binder material and a synthetic fiber comprising at least one of an aramid fiber, a syndiotactic polystyrene fiber, a polyphenylsulfone fiber, a polyphthalamide fiber, and a polyphenylene sulfide fiber.

35. The electrical apparatus of claim 34, wherein the composition of the insulation paper comprises between approximately 2 and 25 weight percent synthetic fiber.

36. The electrical apparatus of claim 34, wherein the composition of the insulation paper comprises between approximately 5 and 20 weight percent synthetic fiber.

37. The electrical apparatus of claim 34, wherein the composition of the paper comprises between approximately 7 and 15 weight percent synthetic fiber.

38. An electrical apparatus comprising:

at least one conductor; and an insulation paper surrounding at least part of the conductor, wherein the insulation paper comprises a wood pulp fiber, aramid fiber, and a binder material.

* * * * *